US009250610B2

(12) United States Patent
Daout

(10) Patent No.: US 9,250,610 B2
(45) Date of Patent: Feb. 2, 2016

(54) SPLIT COLLET WITH A NON-CIRCULAR OPENING

(75) Inventor: Jerome Daout, Rolle (CH)

(73) Assignee: ROLEX S.A., Geneva (CH)

( * ) Notice: Subject to any disclaimer, the term of this patent is extended or adjusted under 35 U.S.C. 154(b) by 529 days.

(21) Appl. No.: 13/636,384

(22) PCT Filed: Mar. 24, 2011

(86) PCT No.: PCT/CH2011/000061

§ 371 (c)(1),
(2), (4) Date: Nov. 16, 2012

(87) PCT Pub. No.: WO2011/116486

PCT Pub. Date: Sep. 29, 2011

(65) Prior Publication Data

US 2013/0047437 A1 Feb. 28, 2013

(30) Foreign Application Priority Data

Mar. 25, 2010 (EP) ..... 10405061

(51) Int. Cl.
*G04B 17/06* (2006.01)
*G04B 17/34* (2006.01)

(52) U.S. Cl.
CPC ..... *G04B 17/345* (2013.01); *Y10T 29/49581* (2015.01); *Y10T 403/70* (2015.01)

(58) Field of Classification Search
CPC ..... G04B 17/345; Y10T 29/49581; Y10T 403/70
USPC ..... 368/175–178; 267/166–168
See application file for complete search history.

(56) References Cited

U.S. PATENT DOCUMENTS

| | | | | |
|---|---|---|---|---|
| 3,785,028 | A | 1/1974 | Muller | |
| 7,018,092 | B2 * | 3/2006 | Muller | 368/140 |
| 7,213,966 | B2 | 5/2007 | Lambert et al. | |
| 2004/0174775 | A1 | 9/2004 | Muller | |
| 2005/0219957 | A1 | 10/2005 | Lambert et al. | |
| 2006/0055097 | A1 | 3/2006 | Conus et al. | |
| 2009/0135679 | A1 | 5/2009 | Musy et al. | |
| 2009/0263182 | A1 | 10/2009 | Bannier et al. | |

FOREIGN PATENT DOCUMENTS

| | | | |
|---|---|---|---|
| CH | 252387 | A | 9/1948 |
| CH | 468 662 | A | 2/1969 |
| CH | 508 233 | A | 12/1970 |
| CN | 1680892 | A | 10/2005 |
| CN | 1745341 | A | 3/2006 |
| EP | 1 302 821 | A2 | 4/2003 |
| EP | 1 331 528 | A2 | 7/2003 |

(Continued)

OTHER PUBLICATIONS

International Search Report of PCT/CH2011/000061, mailing date Aug. 29, 2011.

*Primary Examiner* — Edwin A. Leon
(74) *Attorney, Agent, or Firm* — Westerman, Hattori, Daniels & Adrian, LLP

(57) ABSTRACT

A split collet in which the contour of the central opening that is intended to receive a balance staff is not circular. The collet is characterized in that the contour (3) of the central opening (2) comprises a limited number of supporting parts (4, 5, 12, 14, 15) intended to co-operate with the balance shaft, said number being greater than two.

24 Claims, 7 Drawing Sheets

(56) References Cited

FOREIGN PATENT DOCUMENTS

| | | | |
|---|---|---|---|
| EP | 1 826 635 | A1 | 8/2007 |
| EP | 1 857 891 | A1 | 11/2007 |
| EP | 2 112 565 | A1 | 10/2009 |
| FR | 2124243 | A1 | 9/1972 |

* cited by examiner

SPLIT COLLET WITH A NON-CIRCULAR OPENING

FIELD OF THE INVENTION

The invention relates to a split collet of which the contour of the central opening designed to receive a balance staff is noncircular.

The invention also relates to a collet-hairspring assembly and to a method for installing a clockwork part.

BACKGROUND ART

One of the critical points for the use of a hairspring in a high-precision clockwork movement is the reliability of the attachment of the hairspring to the balance staff. This attachment is usually made by means of a collet, which was originally a small split cylinder designed to be driven onto the balance staff and pierced laterally in order to receive the inner end of the hairspring.

Therefore, Swiss patent No. CH 468662 describes, in particular in connection with its FIG. 3, a collet having four arms, a circular central opening, an elasticity split for the driving onto the balance staff and a recess for the balancing.

The subject of the European patent application published under No. EP 1 302 821 is a split collet with a circular central opening made in one block with a hairspring and comprising balancing recesses.

French patent application number FR 2 124 243 (U.S. Pat. No. 3,785,028) relates to circular sleeves for a hairspring that are designed to be driven onto the balance staff of a watch. These sleeves are manufactured from section pieces having an arm for the attachment of a hairspring and a regulating split diametrically opposite to this arm.

It therefore appears that many solutions for the driving of a collet onto a staff are known, and they are well suited to the usual materials such as steel which have a range of plastic deformation. Specifically, the diameter of the opening provided to receive the balance staff is smaller than the diameter of the balance staff so as to ensure a good hold for the staff after driving. This difference in diameter is usually absorbed at least in part by a plastic deformation of the material of the collet.

This means that these solutions are not very well suited to the collets or to the collet-hairspring assemblies made of a material such as silicon, quartz or diamond. Specifically, these materials, that can be machined by techniques such as deep reactive-ion etching (DRIE), have no range of plastic deformation, which means that they break when the stresses in the material exceed the elastic limit.

For example, Swiss patent No. 508 233 proposes a split collet of which the circular central opening comprises a second split of small-dimension elasticity. As can be seen in particular in FIG. 1, the two halves of this collet are extremely bulky which makes them very rigid and limits the amplitude of their elastic deformation. This makes the collet very fragile, in particular when it is made of a material such as silicon.

The subject of Swiss patent No. CH 252 387 is a collet consisting of two parts, a hollowed-out ring and a U-shaped elastic part placed transversely inside the hollowed-out ring. The two arms of the U are stressed by the hollowed-out ring and must deform in order to pinch the strip of the hairspring and accommodate the balance staff during driving. However, the elasticity at the connection of the arms of the U-shaped part is insufficient, which easily leads to the breakage of this part, in particular when it is made of a material such as silicon.

Moreover, the European patent application published under number EP 2 112 565 reveals microengineering parts having a central opening of which the contour is not circular but has a symmetry of rotation of $2\pi/3$ about the axis passing through the center C of the central opening. FIG. 5 of this document shows in particular a microengineering part furnished with elastic arms.

The solutions described in this document are completely satisfactory for mechanical parts such as wheels. However, they have a number of drawbacks for producing collets that usually have less thickness than wheel plates, such as providing a low range of tolerance for the diameters of the staffs onto which the collets have to be driven.

SUMMARY OF THE INVENTION

The main object of the invention is to propose a collet that can be driven onto staffs of different diameters while ensuring an adequate rotational holding torque without going beyond the elastic limit of the material and without causing an unbalancing mass.

Although split collets have existed for a very long time, hitherto there has never been proposed a split collet having a central opening that is not circular and of which the properties of elasticity make it possible to achieve the aforementioned object, in particular for a material with no range of plastic deformation such as silicon, quartz or diamond.

Therefore, the subject of the invention is a split collet having the particular feature that:

1.—The contour of its central opening comprises a defined or limited number greater than two of bearing portions designed to interact with said balance staff.

In addition to its innovative shape, it has been found that this collet is completely satisfactory in the sense that it is capable of accommodating staffs of different diameters, and that it has, once installed for example on a balance staff, an excellent holding torque on this staff and that its breakage rate during driving for assembly to a staff is practically zero. Additional and advantageous features of the collet as claimed in the invention defined in point 1 above are set out in points 2 to 19 below:

2.—The split collet wherein the radius of curvature of the bearing portions, on the side of the central opening, is negative, infinite or greater than 0.62 times the diameter $d_{max}$ of the largest circle that can be drawn inside the contour of the central opening.

3.—The split collet according to point 2, of which the contour of the central opening has substantially a symmetry of reflection that is orthogonal relative to a straight line R passing through the split of the collet and through the center of the contour of the central opening, and that is parallel to the plane containing the upper face of the collet.

4.—The split collet according to one of points 1 to 3, of which the center of the contour of the central opening is separate from the center of the contour of the collet.

5.—The split collet according to one of points 1 to 4, wherein the radius of curvature of the bearing portions is negative.

6.—The split collet according to one of points 1 to 4, wherein the radius of curvature of the bearing portions is greater than 0.75 times the diameter $d_{max}$ of the largest circle that can be drawn inside the central opening.

7.—The split collet according to point 6, wherein the radius of curvature of the bearing portions is greater than the diameter $d_{max}$ of the largest circle that can be drawn inside the central opening.

8.—The split collet according to one of points 1 to 4, wherein the bearing portions are rectilinear on the side of the center of the contour of the central opening.

9.—The split collet according to one of points 3 to 8, comprising at least one pair of bearing portions situated on either side of the straight line R.

10.—The split collet according to point 9, comprising at least one pair of rectilinear bearing portions wherein one of the rectilinear bearing portions forms with the other rectilinear bearing portion an angle that is greater than or equal to 60 degrees on the side of the center of the contour of the central opening.

11.—The split collet according to point 10, wherein the rectilinear bearing portions form between them an obtuse angle on the side of the center of the contour of the central opening.

12.—The split collet according to one of points 1 to 11, wherein at least one bearing portion is situated on an arm.

13.—The split collet according to point 12, wherein at least two bearing portions are situated on arms placed on either side of the straight line R.

14.—The collet according to point 12 or 13, wherein the arm (or arms) has(have), at its(their) free end(s), on a side opposite to the center a convex bulge.

15.—The split collet according to one of points 1 to 14, comprising three or four bearing portions.

16.—The split collet according to one of points 1 to 15, comprising, on its contour, at a point situated close to the point diametrically opposite to the split, a lug.

17.—The split collet according to one of points 1 to 16, comprising balancing holes.

18.—The split collet according to one of points 1 to 17, consisting of a material containing no range of elastic deformation.

19.—The split collet according to point 18, made of silicon, quartz or diamond.

Moreover, the invention also relates to a collet-hairspring assembly summarized in point 20 as follows:

20.—A collet-hairspring assembly comprising a collet according to one of points 1 to 19 and a hairspring connected at a point situated on the contour of the collet, substantially facing the split.

Point 21 below provides the additional and advantageous features of the collet-hairspring assembly according to the invention:

21.—The collet-hairspring assembly according to point 20, the collet and the hairspring being all in one block.

The invention also relates to a method for installing a clockwork part, comprising the driving of a collet-hairspring assembly according to the invention on to a balance staff.

Other features and advantages of the split collet according to the invention will now be described in detail in the following description which is given with reference to the appended figures which represent schematically, in a view from above:

DETAILED DESCRIPTION OF PARTICULAR EMBODIMENTS

Figure 1:
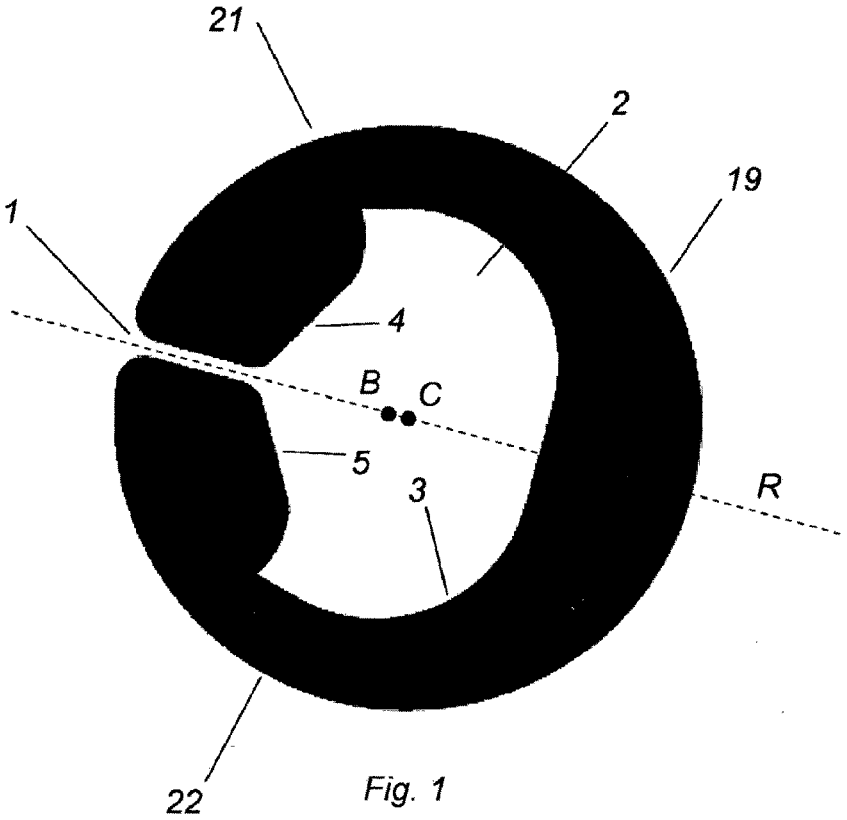
FIG. 1: a collet according to a first embodiment of the invention.

The split collet according to the invention is shown in FIG. 1.

As can be seen, it comprises a split 1 and a central opening 2 that is designed to accommodate a balance staff.

The contour 3 of the central opening 2 is not circular but it preferably has a certain symmetry.

Since the upper face of a collet is generally flat, it is possible to define a plane containing it and, in this plane, a straight line R passing simultaneously through the center B of the central opening 2 and through the middle of the split 1.

The shape of the contour 3 of the central opening 2 is therefore preferably chosen such that this contour 3 has a symmetry of reflection relative to the straight line R. Preferably, this symmetry is orthogonal.

Similarly, the shape of the contour 19 of the collet may be chosen such that this contour 19 also has a symmetry of reflection, preferably orthogonal, relative to the straight line R.

Figure 4:
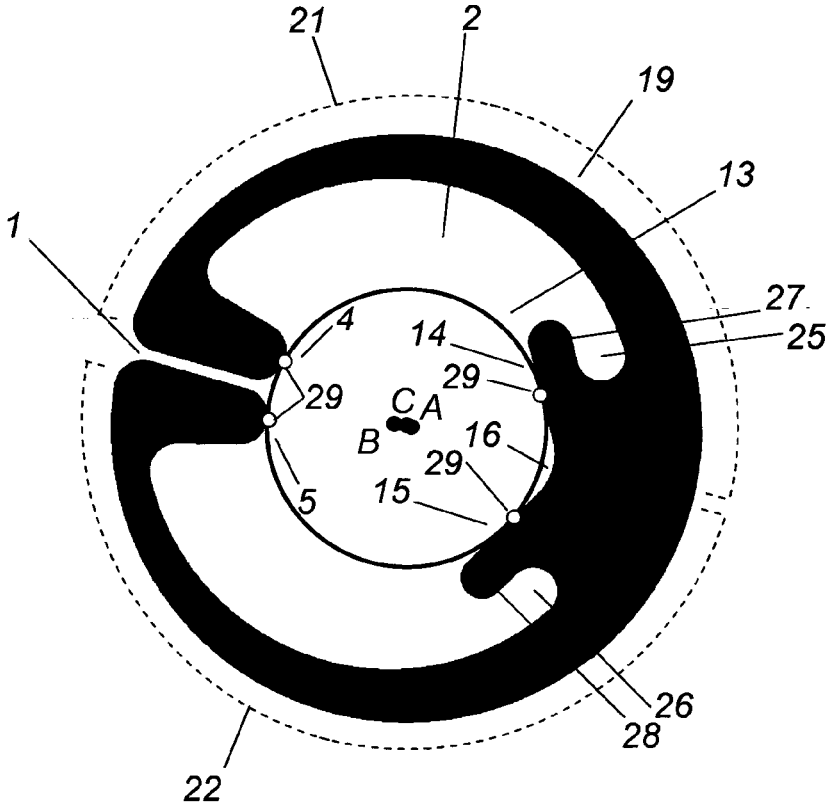

Naturally, this is simply a way of defining the preferred geometry of the central opening 2 because, as can be seen particularly in FIG. 4 of the Swiss patent No. CH 468 662 aforementioned, the lower portion of the split collet may comprise a protuberance.

The aforementioned symmetry of the contour 3 has the advantage of making it possible to prevent an unbalancing mass and to obtain a balanced collet.

However, there is not necessarily symmetry of the contours 3 or 19 relative to the straight line R. Moreover, it is possible to see in FIGS. 3 and 6 to a collet contour 19 that is not symmetrical. Similarly, it is possible to imagine a contour 3 that is not symmetrical, of which the asymmetry would be for example compensated for by a lug situated in the same location as the lug 17 of FIGS. 3 and 6 to 11.

The center B of the central opening 2 may be distinct from the center C of the contour 19 of the collet, as appears in FIG. 1.

According to the invention, the contour 3 of the central opening 2 comprises a first bearing portion 4 and a second bearing portion 5. These bearing portions 4, 5, designed to interact with the balance staff, are preferably symmetrical with one another relative to the split 1. In FIG. 1, these portions 4, 5 are rectilinear, that is to say that their radius of curvature on the side of the central opening 2 is infinite.

The bearing portions 4, 5 may start from points situated on the edge of the split 1.

Figure 2:
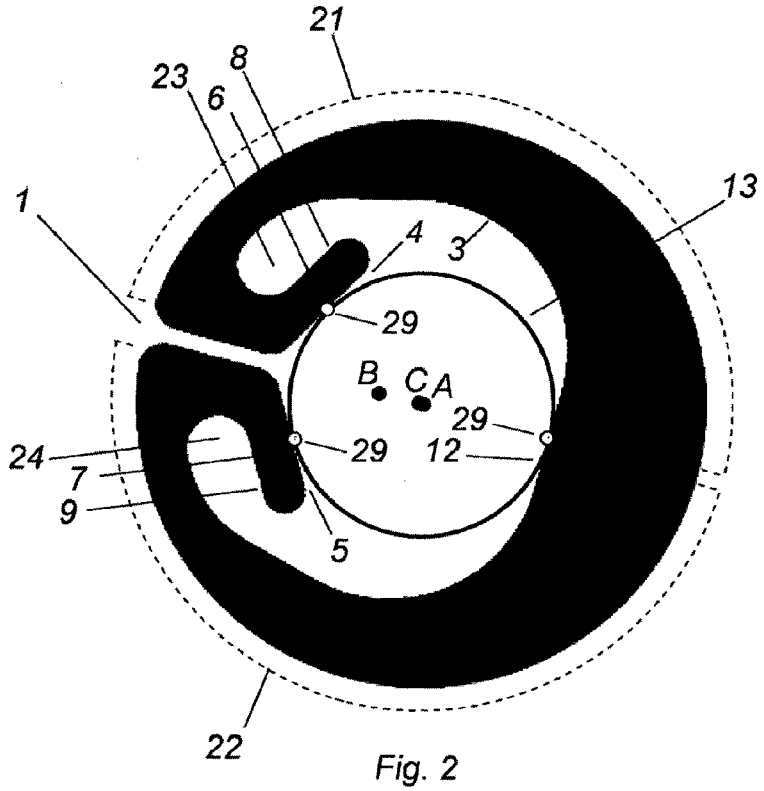
FIGS. 2 to 11: variants of the collet according to the invention.

According to an advantageous embodiment of the invention that can be seen in FIG. 2, on each side of the split 1, an arm 6 or 7 is provided starting from the edge of this split 1.

The arm 6 supports, on its side turned toward the center B, the first rectilinear bearing portion 4 of the contour of the opening. Symmetrically, the arm 7 supports the second rectilinear bearing portion 5.

The role of the arms 6, 7 is on the one hand to form the bearing points of the collet on the balance staff. Moreover, the presence of recesses 23, 24 between the arms and the adjacent portion of the collet makes it possible to maximize the length of the elastic zone of the collet, which then extends up to the split and covers an arc of almost 180° on each half. Without the arms 6, 7 and the recesses 23, 24, the length of the elastic portions would be markedly less and the level of stress would be higher for an equivalent clamping on the staff. Moreover, the stresses may be distributed over a greater distance. It can therefore be seen that the presence of arms 6, 7 defined by the recesses 23, 24 between the arms 6, 7 and the adjacent portion of the collet confers greater strength of the latter.

However, the arms 6, 7 are not generally considered to be elastic arms because, when the collet is driven onto the balance staff, in principle, they do not deform elastically. Specifically, the split of the collet defines two collet halves 21, 22 on either side of the straight line R, indicated by dashed lines in FIG. 2. It is the shapes of these two halves 21, 22 that give the collet all its elasticity. This fact is confirmed by simulations of driving the collet of FIG. 2 which show that there is no elastic deformation of the arms 6, 7 as a result of the driving of a staff.

Therefore, the length and the shape of the arms 6, 7 which are defined by the recesses 23, 24 situated between the arms 6, 7 and the collet, on the side opposite to the center B, are second order parameters. On the other hand, the shape of the collet halves 21, 22 is important and is chosen so as to distribute the elastic stresses as evenly as possible along the contour of the collet and over the two collet halves 21, 22, while ensuring simultaneously sufficient elasticity to allow the driving of balance staffs of which the diameter is included in the desired tolerance range and a stress level that always remains markedly below the elastic limit of the material. This choice can be made, for example, following an optimization of the shape of the collet halves 21, 22 with the aid of a numerical simulation program using the finite elements method, such as ANSYS.

Moreover, the presence of the arms 6, 7 makes it possible to bring the corresponding bearing point(s) closer to the center of the collet without thickening the collet halves 21, 22 and therefore without stiffening them. This therefore makes it possible to optimize separately the placement of the bearing points and the properties of elastic deformation of the collet (amplitude of deformation, distribution of the stresses, etc.).

As can be seen in FIG. 2, the side 8, 9 of each arm 6, 7 opposite to the center B may also be rectilinear.

Figure 3:
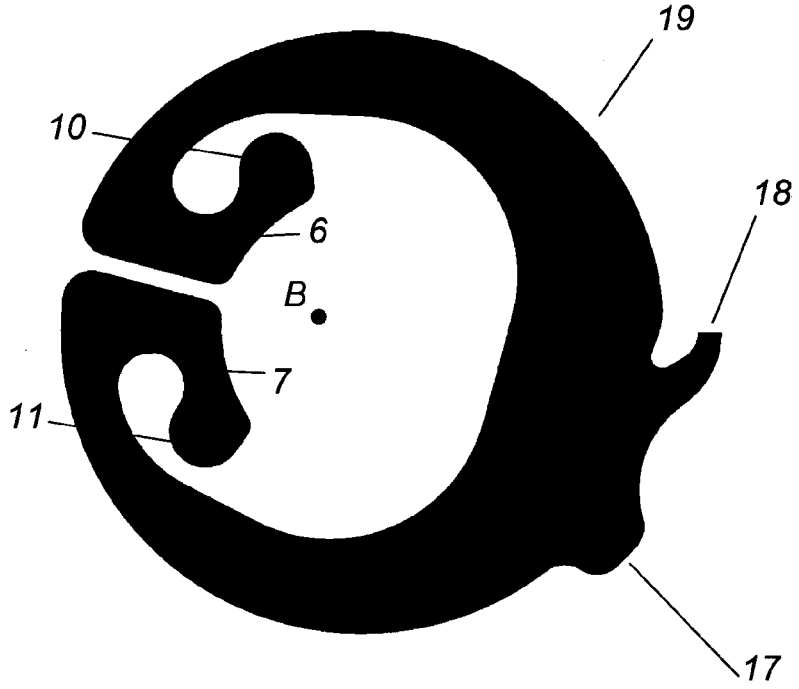

However, as can be seen in FIG. 3, each arm 6, 7 is preferably furnished, at its free end and on the side opposite to the center B, with a bulge 10, 11. This bulge makes it possible to optimize yet more the balance by adding material but it does not serve as a bearing or abutment point.

As can be seen in FIG. 3, the bearing portions may be concave, that is to say that the radius of curvature of the bearing portions may be positive on the side of the central opening 2.

The central opening 2 is designed to accommodate a balance staff which usually has a circular cross section. Depending on the shape of the central opening 2, there may therefore be more or fewer contact points 29 between the balance staff and the split collet.

Again making reference to FIG. 2, it can be seen that the contour 3 of the central opening 2 may comprise a third bearing portion 12 situated facing the split 1. Preferably, the tangent at the point 29 closest to the center B of the contour 3 of the central opening 2 is substantially perpendicular to the straight line R (or to the split 1). This point 29 is the point of contact provided with the balance staff.

In this figure, the bearing portion 12 is rectilinear, but it could also be convex or concave.

Therefore, it can be seen that the balance staff, of which the periphery is symbolized by the circle 13 with its center A in the figure, comes into contact with the central opening 2 in three locations 29: on each of the first and second rectilinear bearing portions 4, 5 of the arms 6, 7 and on the third bearing portion 12, just opposite the split 1, at the point of intersection with the straight line R. On this subject, it is evident that the centers of the contours will move very slightly following the driving of the balance staff.

FIG. 4 shows a variant of the split collet shown in FIG. 1. Here, the contour of the opening 2 comprises a fourth bearing portion 14 and a fifth bearing portion 15. These bearing portions 14, 15 are symmetrical with one another relative to the split 1 and they join at a point 16 situated preferably facing the split 1. This configuration makes it possible to obtain four points of contact 29 between the balance staff and the central opening 2: two points of contact on the first and second bearing portions 4, 5, which are convex in this example, and two other points of contact on the fourth and fifth bearing portions 14, 15, which are rectilinear in this example.

Therefore, in FIG. 4, the bearing portions 4, 5 have, on the side of the central opening 2, a negative radius of curvature while the bearing portions 14, 15 have an infinite radius of curvature.

Moreover, the elastic portion of each collet half 21, 22 has been maximized by defining recesses 25, 26 and arms 27, 28 supporting the bearing portions 14, 15. Again the shape of the collet halves 21, 22 is chosen so as to distribute the elastic stresses evenly along the contour of the collet.

Figure 5:
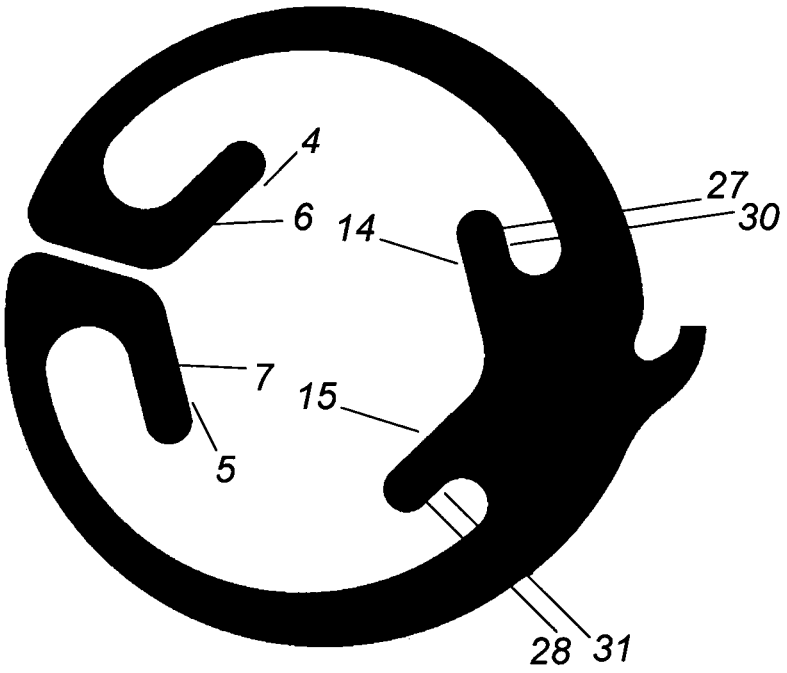

FIG. 5 shows a split collet with arms 6, 7 and 27, 28 supporting bearing portions 4, 5 and 14, 15 that are rectilinear, as in FIG. 2, but of which the contour 3 of the central opening 2 provides four points of contact with the balance staff.

Figure 6:
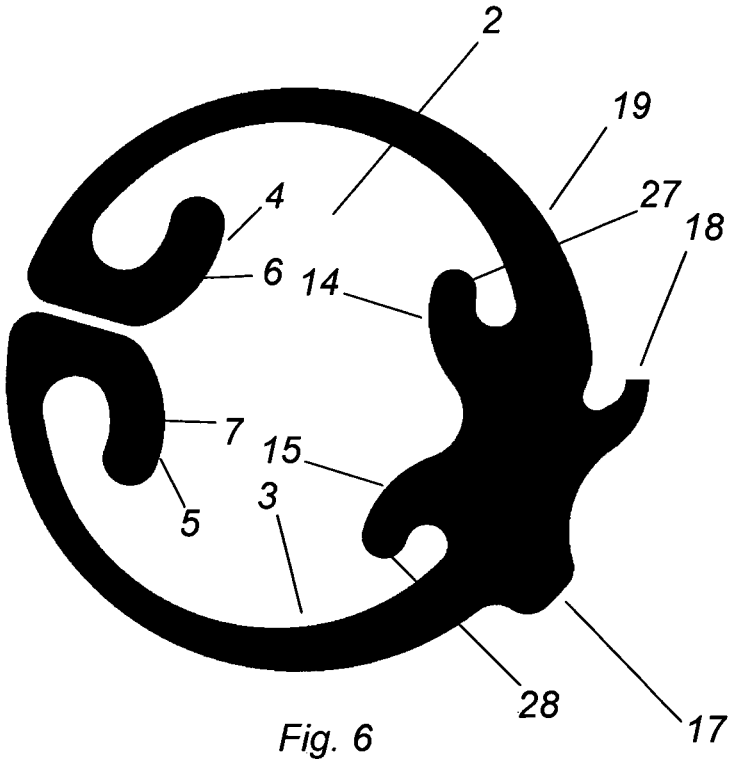
Figure 7:
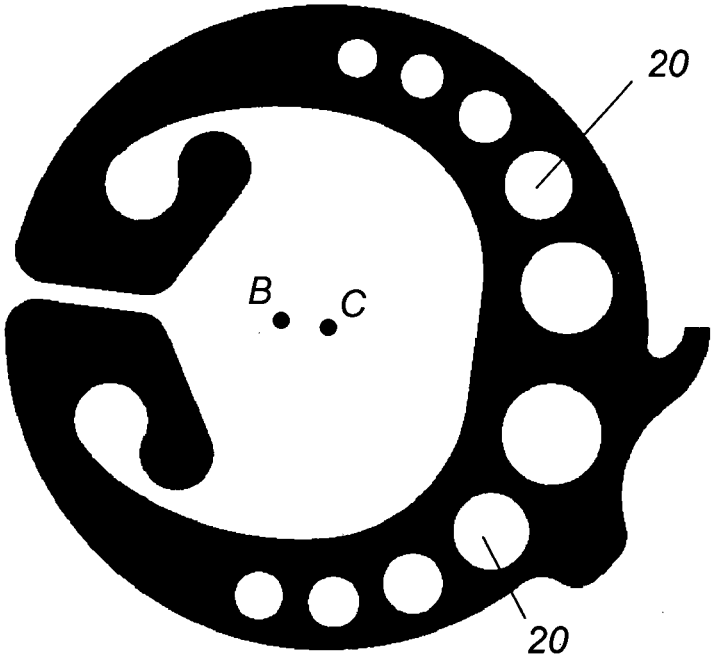
Figure 8:
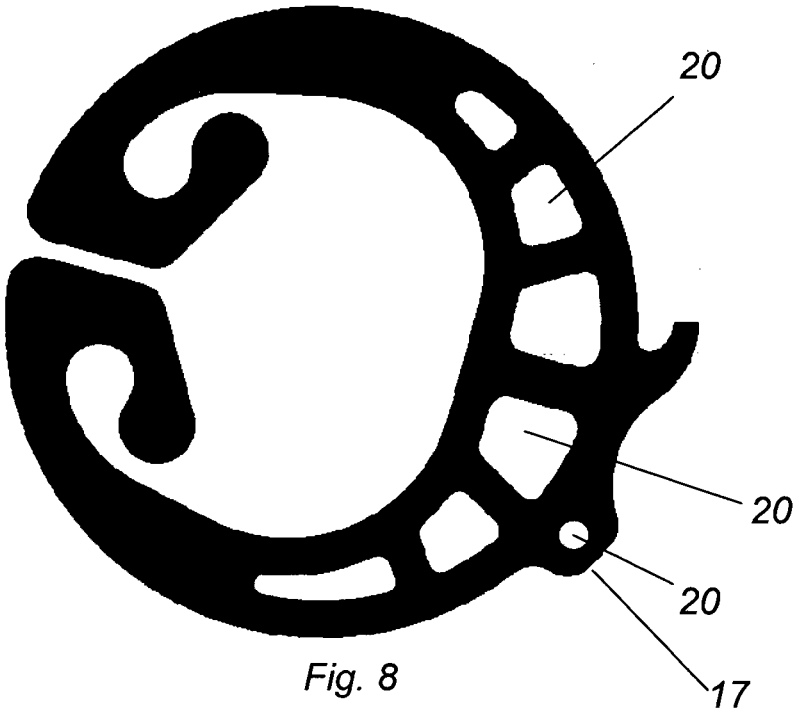
Figure 9:
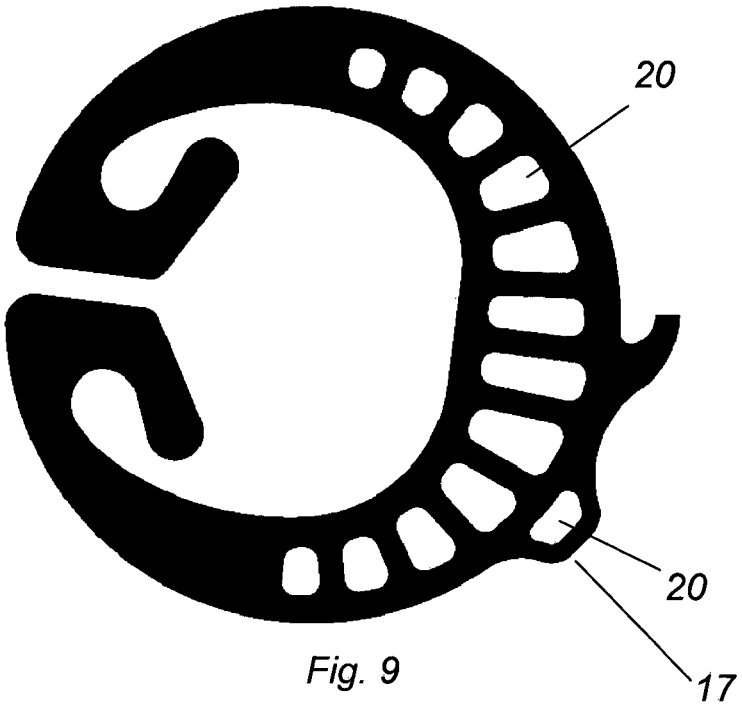
Figure 10:
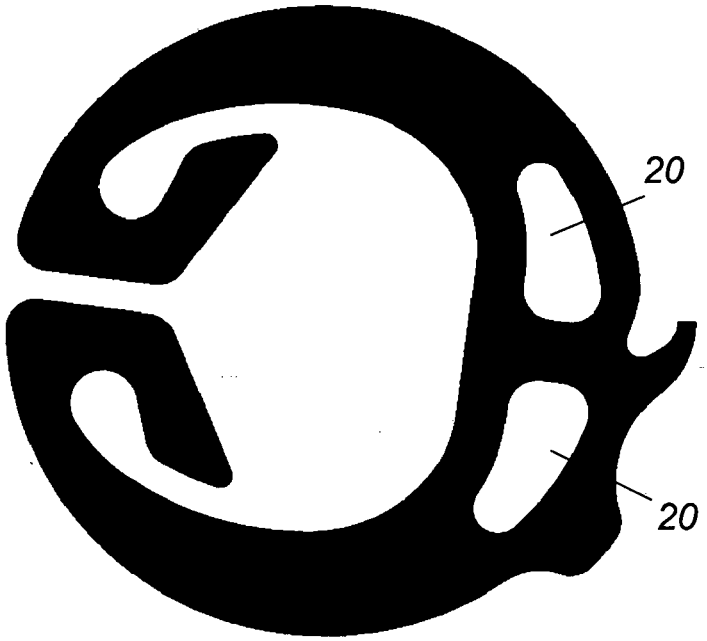

FIG. 6 shows a split collet with arms 6, 7 and 27, 28, but of which the contour 3 of the central opening 2 defines four points of contact with the periphery of the balance staff. The bearing portions 4, 5 and 14, 15, in this example, are all convex, that is to say that their radius of curvature on the side of the center B of the central opening 2 is negative.

As can be seen in FIG. 6 with respect to the convex bearing portions or in FIG. 3 to the concave bearing portions, the tangents at the points of contact provided between the portions 4, 5 and the balance staff and/or between the portions 14, 15 and the balance staff can form between them an angle that is greater than or equal to 60 degrees, and even obtuse, on the side of the center of the central opening 2.

The contour 19 of the collet according to the invention is generally substantially circular. "Substantially" here means that it is not 100% circular because of the existence of the split 1 and, if necessary, as can be seen in FIGS. 3 and 6, because of the presence, at a point situated close to the point diametrically opposite to the split 1, of a lug 17. The latter is preferably situated upstream of the attachment point or the point of departure of the hairspring (if reference is made to the direction of unwinding of the hairspring from inside to outside). The contour 19 may also be noncircular, or even asymmetrical. It could therefore protect the turns in the event of impact. In this case, it will however be necessary to ensure that the collet is balanced so as not to cause an unbalancing mass, and to dimension the two collet halves 21, 22 so that they act as symmetrically as possible, so as to minimize the movement of the attachment point of the hairspring during assembly with the staff.

The split collet according to the invention is, by definition, intended to support a hairspring. The beginning of the latter is visible in FIGS. 3 and 6 where it bears the reference number 18.

This hairspring 18 is preferably connected to the collet at a point situated on the contour 19 of the latter, substantially opposite the split 1. This makes it possible to minimize the movement of the hairspring when installing the collet on a balance staff and to avoid affecting the chronometric properties. The example of FIG. 2, in which one of the contact points is situated on or close to the straight line R, opposite the split 1, is particularly favorable.

The hairspring may be a part fixed on the collet, but preferably it forms only one part with it.

Advantageously, balancing holes 20 are provided in a portion of the collet opposite to the split 1, if necessary, even in the lug 17, as can be seen in the variants shown in FIGS. 7 to 10.

Moreover, as can be seen by again making reference to FIGS. 2 and 4, the point A representing the longitudinal axis of symmetry of the balance, the center B of the contour 3 of the central opening 2 of the collet and the geometric center C of the contour 19 of the collet may all three be distinct.

The split collet according to the invention is designed simultaneously to hold the hairspring 18 on the balance staff during operation of the oscillator (minimal clamping torque) and also in order to be able to be assembled with staffs of which the diameters have fluctuations and this is done without breaking or sustaining plastic deformation if the diameter of the balance staff remains within a given tolerance range. This point is particularly important if the collet is made of a material such as silicon which has no range of plastic deformation, because the risk of breakage or of cracking is significant if the stress exceeds the limit of elastic deformation.

As emerges from the foregoing, the bearing portions 4, 5 and/or 14, 15 and/or 12 may be rectilinear (FIGS. 1, 2, 5, 7, 8, 9, 10 and 13), that is to say that they may have an infinite radius of curvature, convex, that is to say with a negative radius of curvature on the side of the central opening 2 (see portions 4, 5 of FIG. 4, FIG. 6, FIG. 11), or concave (FIG. 3), that is to say with a positive radius of curvature. However, in the latter case, the positive radius of curvature is greater than 0.62 times the diameter $d_{max}$ of the largest circle that can be drawn inside the contour of the central opening, a circle that is also called the "inscribed circle" in the rest of the description. This circle corresponds approximately to the circle 13 of center A that can be seen in FIGS. 2 and 4, except that the inscribed circle has a slightly smaller diameter than that of the balance staff. Specifically, a radius of curvature that is positive and greater than 0.62 times the diameter $d_{max}$ of the inscribed circle makes it possible to define a single point of contact between the bearing portion and the balance staff: in the case of FIG. 3, a radius of curvature that is greater than 0.62 times the diameter $d_{max}$ of the inscribed circle results in a space of 5 microns approximately at the ends of the arms if the point of contact is placed at the center of the arms, which is suitable for defining a single point of contact. Similarly, a radius of curvature greater than the diameter $d_{max}$ of the inscribed circle results in a space of 10 microns at the ends of the arms. A radius of curvature that is greater than 0.75 times the diameter $d_{max}$ of the inscribed circle is also an appropriate value.

Preferably, and irrespective of the envisaged embodiment, the tangents at the bearing points 4, 5 and/or 14, 15 at the points of contact provided with the balance staff form between them, on the side of the center B of the central opening 2, an angle that is preferably greater than or equal to 60 degrees. Yet more preferably, it is an obtuse angle.

It should be noted that the bearing portions 4, 5 and/or 14, 15 and/or 12 are configured so as to each define a precise point of contact 29 with the balance staff. Being able to define the configuration and the number of points of contact makes it possible to achieve the best balance of the forces that act on the balance staff. This is not the case with a collet according to the prior art of which the radius of the inner opening is substantially equal to or less than the radius of the balance staff, and of which the bearing points are not defined.

The split collet according to the invention may be made of any appropriate material, such as silicon, quartz, diamond, etc. It may be manufactured by means of well-known techniques of micromanufacturing, such as the DRIE methods for silicon, quartz or diamond or UV-Liga for Ni or NiP. These techniques have the advantage of making it possible to easily produce very complex shapes or geometries.

Figure 11:
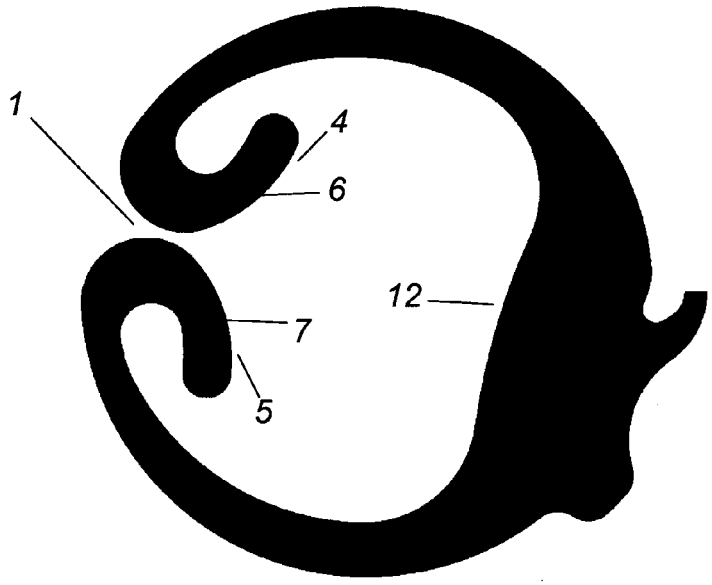

Therefore, for example, the shape of the split 1 is not necessarily elongate. FIG. 11 shows a split collet according to the invention of which the split 1 has rounded ends. Also note that the arms 6, 7 support convex bearing portions and that the third bearing portion 12 is also convex.

Figure 13:
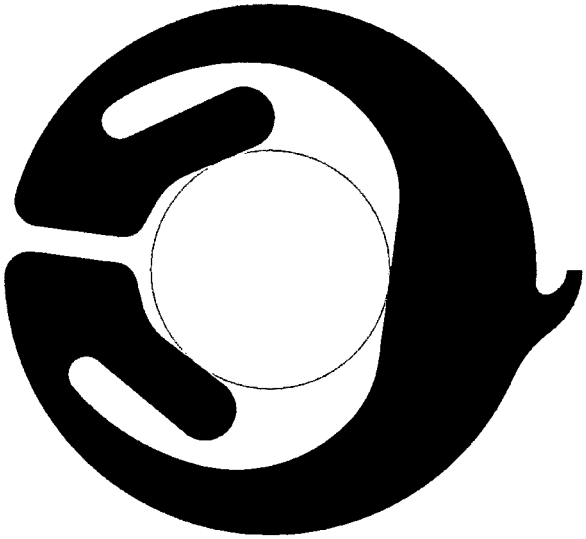
FIG. 13: another variant of the collet according to the invention.

FIG. 13 shows a collet of which the bearing portions form an equilateral triangle and are placed at 120° from one another, thus making it possible to balance the forces at the clamping of the staff.

Naturally, the various forms of execution presented above are not limiting and the various features may be combined with one another provided that they are compatible. Thus, it is totally possible to produce a collet that combines the two convex bearing portions 4, of the collet of FIG. 4 with the rectilinear bearing portion 12 of the collet of FIG. 2.

According to the invention, each bearing portion is designed to define a single point of contact with the balance staff.

The bearing portions may exhibit radii of curvature that differ from one another. Moreover, it is also possible to vary the radius of curvature along one and the same bearing portion.

Method for Mounting a Clockwork Part

During the mounting of a clockwork part, when the collet-hairspring assembly according to the invention is driven onto the balance staff, each collet half 21, 22 has the advantageous particular feature of deforming elastically, that is to say without plastic deformation or risk of breakage.

Comparative Tests with Respect to EP 2 112 565

Figure 12:
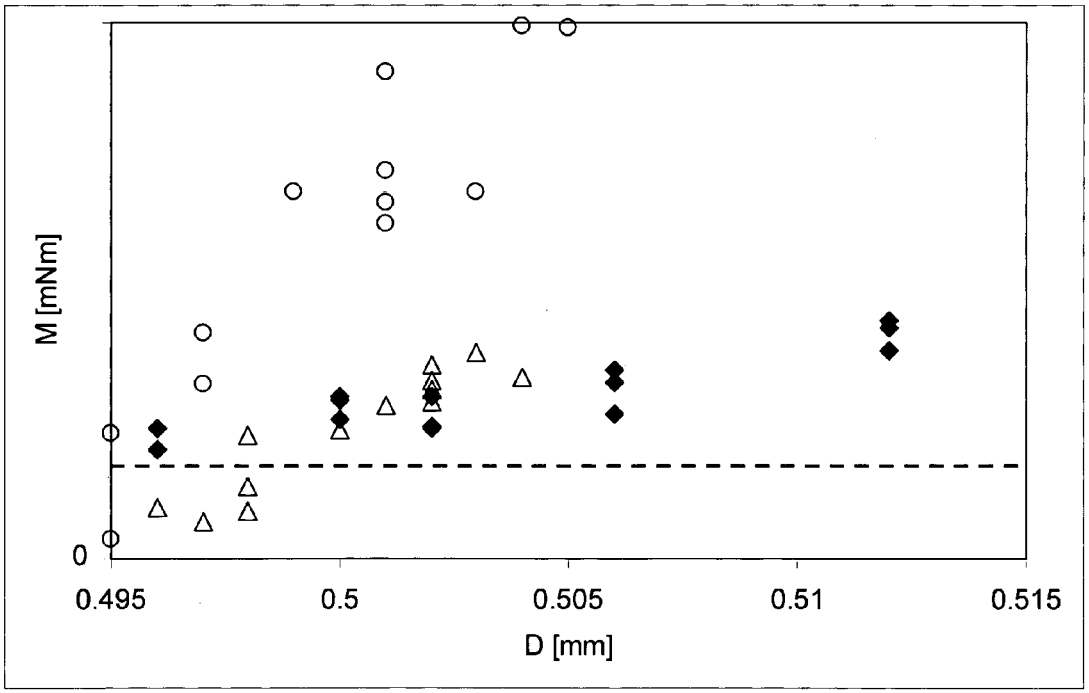
FIG. 12: a graph representing the change in holding torque of the collet as a function of the diameter of the balance staff onto which is driven.

FIG. 12 is a graph representing the change in the holding torque M of the collet as a function of the diameter D of the balance staff, for split collets according to the invention and unsplit collets according to the prior art, namely the aforementioned European patent application No. EP 2 112 565.

All the parts have been manufactured in silicon according to the DRIE method.

The measurements were taken on a Variocouple apparatus of the company CSM Instruments.

The balance staffs used had a diameter of between 0.495 and 0.512 mm. The desired tolerance range is in this case between 0.500 and 0.506 mm. The diameter $d_{max}$ of the inscribed circle was 0.485 mm.

In the graph, the results of the measurements taken with a split collet according to FIG. 2 are symbolized by the solid diamond shapes, the results obtained with a collet according to FIG. 4 of EP 2 112 565 are shown by circles and those given by a collet according to FIG. 5 of EP 2 112 565 are shown by empty triangles.

Tests carried out with split collets with a circular central opening, similar to those described in U.S. Pat. No. 3,785,028 (FR 2 124 243) have not been satisfactory because of many breakages found when driving and torque holds that are too weak for most of the collets that were able to be assembled successfully. The experiment shows that, for this type of geometry, it is preferable to use a split counter-collet made of metal and/or to secure the split collet made of silicon to the staff by bonding.

The results are considered satisfactory when the holding torque M is greater than the minimal holding value indicated in dashed lines.

It is found therefore, on the one hand, that the dependence of the holding torque M on the diameter is more marked for collets according to the prior art, and on the other hand, that it is difficult to achieve the minimal holding value when the diameter of the staff is small with these same collets according to the prior art.

With the split collet according to the invention, the holding torque is greater than the required minimal torque, even for small diameters below the minimal tolerance, and the dependence on the diameter is markedly less (a slope less by a factor of three and six respectively than those of the collets of the prior art).

Moreover, no breakage was found during driving, even for the large diameters greater than the maximum tolerance, while typically 10% of breakage is observed with the collets according to the prior art.

Tests on the Split Collet According to CH 508233

Simulations were made with the collet described in aforementioned Swiss patent CH 508233, in order to see whether this type of geometry is suitable for producing a collet made of Si. An inscribed diameter $d_{max}$ of 0.485 mm was also chosen. It was found that this collet breaks when the balance staff onto which it is driven has a diameter greater than 0.490 mm (or 1.01×0.485 mm). The value range of the tolerated diameters is therefore less than 6 μm. Moreover, it is probable that even for the limit situation of 0.490 mm, the hold on the staff is too weak.

Tests on the Collet with a U-Shaped Part According to CH 252387

Simulations were made with the two-part collet described in the aforementioned Swiss patent CH 252387 in order to see whether this type of geometry is suitable for producing a collet in Si. An inscribed diameter $d_{max}$ of 0.485 mm had also been chosen. It was found that this collet breaks with balance staff diameters greater than 0.495 mm (namely 1.02×0.485 mm) if no account is taken of the hollowed-out ring. These results are therefore better than those for the collet of Swiss patent CH 508233, but still inadequate. Moreover, if the hollowed-out ring is taken into account, breakage occurs even more rapidly. This can be explained by the fact that it is the portion situated at the zone of connection between the two arms of the U-shaped part which deforms and not the two arms. In the invention, on the contrary, the elasticity of the whole length of the two collet halves 21, 22 is made use of to accommodate the staff.

The invention claimed is:

1. A split collet comprising:

a central opening designed to receive a balance staff, wherein the central opening is noncircular, wherein a contour of the central opening comprises a limited number greater than two of bearing portions designed to interact with said balance staff, and wherein the contour of the central opening has substantially a symmetry of reflection that is orthogonal relative to a straight line passing through a split of the collet and through a center of the contour of the central opening, the straight line being parallel to a plane containing an upper face of the collet.

2. The split collet as claimed in claim 1, wherein a radius of curvature of the bearing portions, on a side of the central opening, is negative, infinite or greater than 0.62 times a diameter of a largest circle that can be drawn inside the contour of the central opening.

3. The split collet as claimed in claim 1, wherein the center of the contour of the central opening is separate from the center of a contour of the collet.

4. The split collet as claimed in claim 1, wherein a radius of curvature of the bearing portions is negative.

5. The split collet as claimed in claim 1, wherein a radius of curvature of the bearing portions is greater than 0.75 times the diameter of the largest circle that can be drawn inside the central opening.

6. The split collet as claimed in claim 5, wherein the radius of curvature of the bearing portions is greater than the diameter of the largest circle that can be drawn inside the central opening.

7. The split collet as claimed in claim 1, wherein the bearing portions are rectilinear on the side of the center of the contour of the central opening.

8. The split collet as claimed in claim 1, comprising at least one pair of bearing portions situated on either side of the straight line.

9. The split collet as claimed in claim 8, wherein the bearing portions of the at least one pair of bearing portions are rectilinear bearing portions, and wherein one of the rectilinear bearing portions forms an angle with the other rectilinear bearing portion, and wherein the angle is greater than or equal to 60 degrees on the side of the center of the contour of the central opening.

10. The split collet as claimed in claim 9, wherein the angle is an obtuse angle on the side of the center of the contour of the central opening.

11. The split collet as claimed in claim 1, wherein at least one of the bearing portions is situated on an arm.

12. The split collet as claimed in claim 11, wherein at least two of the bearing portions are situated on arms placed on either side of the straight line.

13. The split collet as claimed in claim 11, wherein the arm has a convex bulge at a free end of the arm, on a side opposite to the center of the contour of the central opening.

14. The split collet as claimed in claim 1, comprising three or four bearing portions.

15. The split collet as claimed in claim 1, comprising a lug provided on a contour of the collet, and at a point situated close to a point diametrically opposite to the split.

16. The split collet as claimed in claim 1, comprising balancing holes.

17. The split collet as claimed in claim 1, consisting of a material containing no range of elastic deformation.

18. The split collet as claimed in claim 17, wherein the collet is made of silicon, quartz or diamond.

19. A collet-hairspring assembly comprising:

a collet as claimed in claim 1, and a hairspring connected at a point situated on a contour of the collet, the hairspring substantially facing a split in the collet.

20. The collet-hairspring assembly as claimed in claim 19, wherein the collet and the hairspring are all in one block.

21. A method for installing a clockwork part, comprising driving a collet-hairspring assembly as claimed in claim 19 onto a balance staff.

22. A split collet comprising:

a central opening designed to receive a balance staff, wherein the central opening is noncircular, wherein a contour of the central opening comprises a limited number greater than two of bearing portions designed to interact with said balance staff, wherein at least one of the bearing portions is situated on an arm, and wherein the bearing portions are configured so as to each define a precise point of contact with the balance staff.

23. The split collet as claimed in claim 22, wherein at least two of the bearing portions are situated on arms placed on either side of a straight line passing through a split of the collet and through a center of the contour of the central opening, the straight line being parallel to a plane containing an upper face of the collet.

24. The split collet as claimed in claim 22, wherein the bearing portions are rectilinear, convex, or concave with a radius of curvature larger than a radius of a balance staff that the central opening is adapted to receive.

* * * * *